US005090096A

United States Patent [19]

Terada et al.

[11] Patent Number: 5,090,096

[45] Date of Patent: Feb. 25, 1992

[54] PULL TAB FOR SLIDE FASTENER SLIDERS

[75] Inventors: Yasuharu Terada, Uozu; Susumu Ishii, Kurobe, both of Japan

[73] Assignee: Yoshida Kogyo K.K., Tokyo, Japan

[21] Appl. No.: 704,381

[22] Filed: May 23, 1991

[30] Foreign Application Priority Data

Jun. 7, 1990 [JP] Japan ..... 2-60437[U]

[51] Int. Cl.[5] ..... A44B 19/26

[52] U.S. Cl. ..... 24/431; 24/419; 24/429

[58] Field of Search ..... 24/431, 419, 429, 430

[56] References Cited

U.S. PATENT DOCUMENTS 2,221,759 11/1940 Erard ..... 24/431
3,583,044 6/1971 Howell ..... 24/431
3,641,634 2/1972 Asai ..... 24/429
4,368,562 1/1983 Minami ..... 24/431
4,704,770 11/1987 Minami et al. ..... 24/431
4,928,358 5/1990 Ishii et al. ..... 24/431

*Primary Examiner*—Victor N. Sakran
*Attorney, Agent, or Firm*—Hill, Van Santen, Steadman & Simpson

[57] ABSTRACT

A pull tab for slide fastener sliders comprises a pull tab body being of a flat strip and having a through hole therein and a decorative body comprising a first decorative part and a second decorative part, both decorative parts joined with each other through the through hole of the pull tab body, so that the decorative body is attached to the pull tab body.

7 Claims, 9 Drawing Sheets

PULL TAB FOR SLIDE FASTENER SLIDERS

BACKGROUND OF THE INVENTION

1. Field of the Invention

The present invention relates generally to a slider for a slide fastener attached to a garment, a bag or the like article, and more particularly to a decorative pull tab for such slide fastener sliders.

2. Description of the Prior Art

Originally, a pull tab only had to function to be gripped and pulled by a wearer to manipulate the slider along the fastener stringers for opening and closing the slide fastener. As individuality prevails in garment or fashion industries recently like other fields, so even a very tiny accessary like a pull tab of a slider must appeal aesthetically to purchasing public.

Various pull tabs have been proposed to meet the requirement so far. A typical pull tab of the type described is disclosed in French Patent No. 1,531,615. The conventional pull tab disclosed in the publication comprises a pull tab body having a circular shallow recess and a decorative disk which is complementary in size and shape with the recess and which has a decorative pattern on its outer surface. In the bottom of the circular recess, two small holes are formed through the pull tab, while the decorative disk has the corresponding two studs provided on its inner surface. The circular disk is snugly embedded in the recess with the two studs received in the respective holes. Subsequently, the free ends of the studs protruding beyond the lower surface of the pull tab are stamped by a die or the like device, to be thus flattened or otherwise deformed so that the decorative disk is firmly clinched to the pull tab.

However, the conventional pull tab has some drawbacks. Firstly, a special die or the like device is indispensable for the purpose of clinching the decorative disk to the pull tab body. Therefore, it is impossible for consumers themselves to attach to the pull tab the decorative pattern as they wish at their home. Secondly, the flattened or deformed ends of the studs of the decorative disk are clumsily exposed on the rear side of the pull tab, thereby damaging the appearance of the pull tab as a whole.

SUMMARY OF THE INVENTION

With the foregoing difficulties in view, it is, therefore, an object of the present invention to provide a pull tab for a slide fastener slider to which a decorative body can be easily attached by a simple tool available at home like pliers as a wearer wishes.

It is another object of the present invention to provide a pull tab for a slide fastener slider wherein deformed part of a decorative body which is clinched to the pull tab is completely hidden from viewers, thus enhancing aesthetical quality of the pull tab as a whole.

According to the present invention, there is provided a pull tab to be pivotally connected with a slider body of a slide fastener slider for manipulation of the slider, the pull tab comprising; a pull tab body being of a flat strip and having a through hole therein; and a decorative body comprising a first decorative part having a pair of opposed clamping nails on an inner surface and a second decorative part having an engaging ridge provided on an inner surface, the engaging ridge having a concave recess therein and a pin supported substantially axiallly in the concave recess; the first decorative part being joined with the second decorative part, with the ridge received in the through hole of the pull tab body, by forcing the clamping nails of the first decorative part into the concave recess astraddle of the pin, thereby clinching them to the pin, so that the decorative body is attached to the pull tab body.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
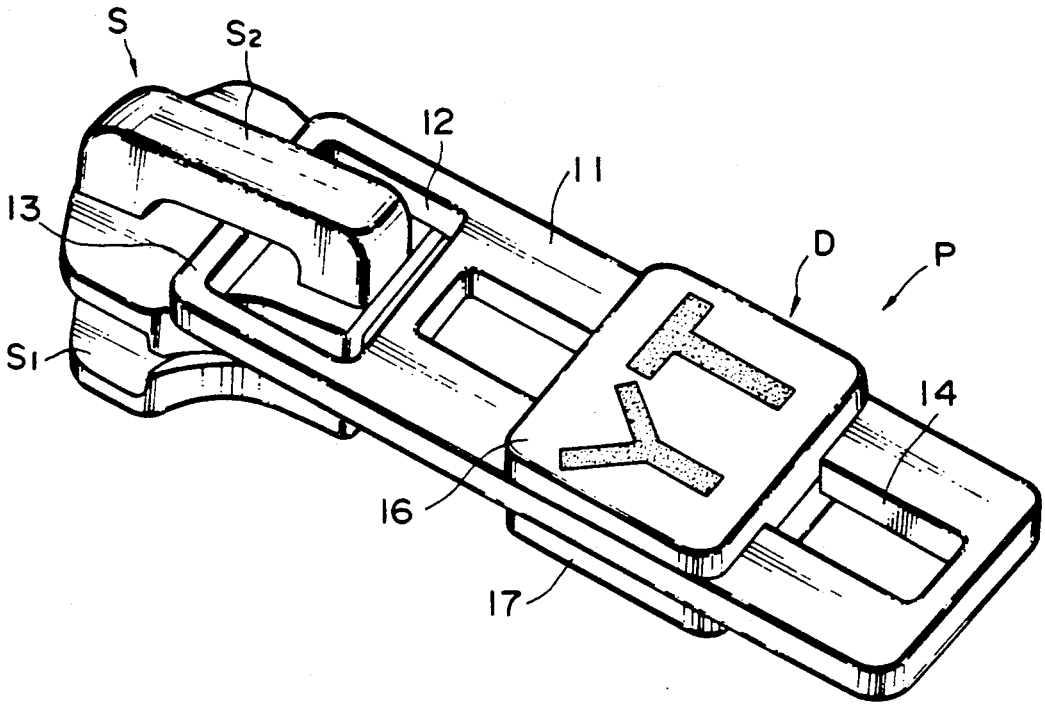
FIG. 1 is a perspective view of a slide fastener slider incorporating a pull tab according to a first embodiment of the present invention.

FIG. 1 shows a slider S incorporating a pull tab P according to a first embodiment of the present invention. The slider S broadly comprises a slider body S1, an attachment lug S2 provided on the upper surface of the slider body S1 and the pull tab P pivotally connected to the attachment lug S2 for manipulating the slider S by gripping and pulling the pull tab P.

As shown in FIG. 1, the pull tab P generally comprises a pull tab body 11 and a decorative body D mounted on the pull tab body 11 in the manner as closely described hereinbelow.

The pull tab body 11 is an elongated rectangular flat strip made of metal and has a rectangular connecting aperture 12 at its one end, thus leaving a transverse pintle 13 at said one end. The pull tab body 11 further includes an elongated rectangular slot 14 extending longitudinally of and substantially throughout the entire length of the pull tab body 11 except for the connecting aperture 12.

Figure 3:
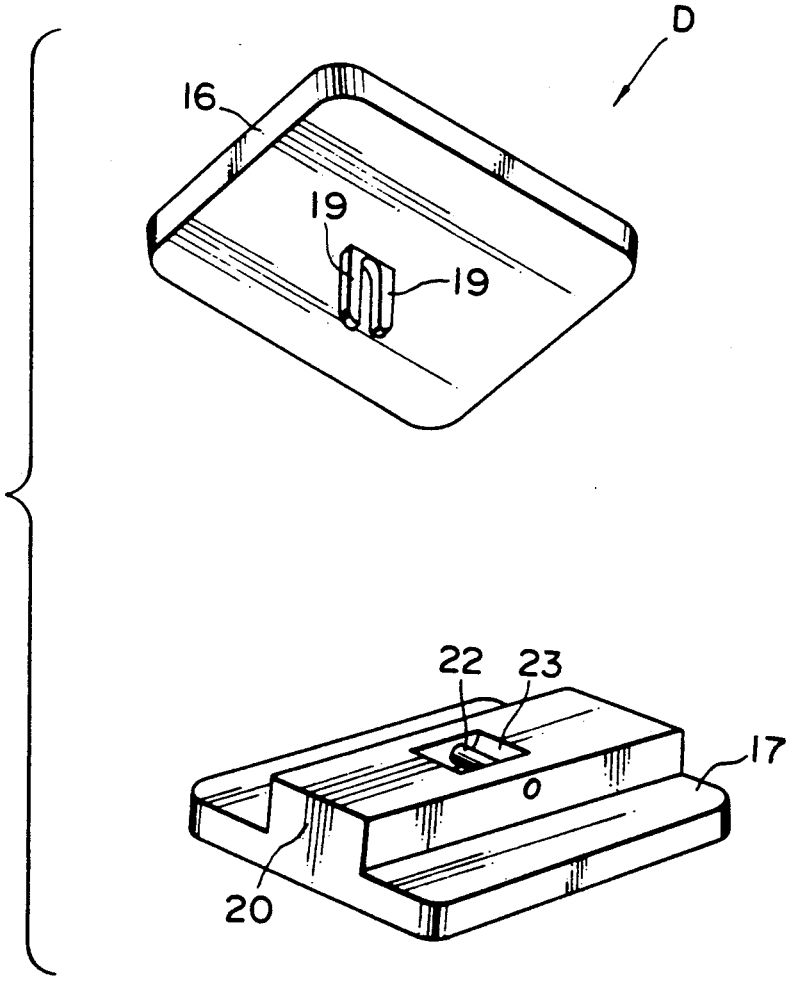
FIG. 3 is an exploded perspective view of a decorative body incorporated in the pull tab of FIG. 1.

As better shown in FIG. 3, the decorative body D comprises a first decorative part 16 and a second decorative part 17 both made of metal and joined with each other through the rectangular slot 14, as closely described hereinbelow. The first and second decorative parts 16, 17 may be colored different from the pull tab body 11 by means of painting, plating, surface treatment, coating with a plastic layer and so forth. Alternatively, only the outer surface of the first decorative part 16 may bear a decorative pattern like the initials "YT" as shown in FIG. 1.

The first decorative part 16 is a substantially square and flat plate and has a pair of spaced parallel clamping nails 19, 19 on the inner surface substantially at its middle.

The second decorative part 17 is also a substantially square and flat plate. It has a rectangular parallelopiped ridge 20 provided in the middle on the inner surface thereof so as to extend throughout the entire length of the second decorative part 17. The ridge 20 is slightly less in width than the elongated slot 14 of the pull tab P. A concave recess 23 is formed in the middle in the upper side of the ridge 20. A pin 22 has its opposite ends fixed to the opposed inner walls of the concave recess 23 so as to be axially supported in the concave recess 23.

With the pull tab P according to the present invention thus constructed, the decorative body D is attached to the pull tab body 11 to make up the pull tab P, in the manner described hereinbelow. First, the ridge 20 of the second decorative part 17 is inserted into the elongated slot 14 from below as viewed in FIG. 1. Then, the first decorative part 16 is placed on the upper surface of the ridge 20 with the clamping nails 19, 19 riding astraddle the pin 22 in the concave recess 23. Pressing the first decorative part 16 against the second decorative part 17 in this disposition forces the opposed clamping nails 19, 19 bend along the concave recess 23 astraddle of the pin 22, thereby clinching the clamping nails 19, 19 to the pin 22, so that the first decorative part 16 is joined with the second decorative part 17 with the ridge 20 received in the elongated slot 14 in the pull tab body 11. As a result, the decorative body D is slidably attached to the pull tab body 11, as better shown in FIG. 1.

Figure 4:
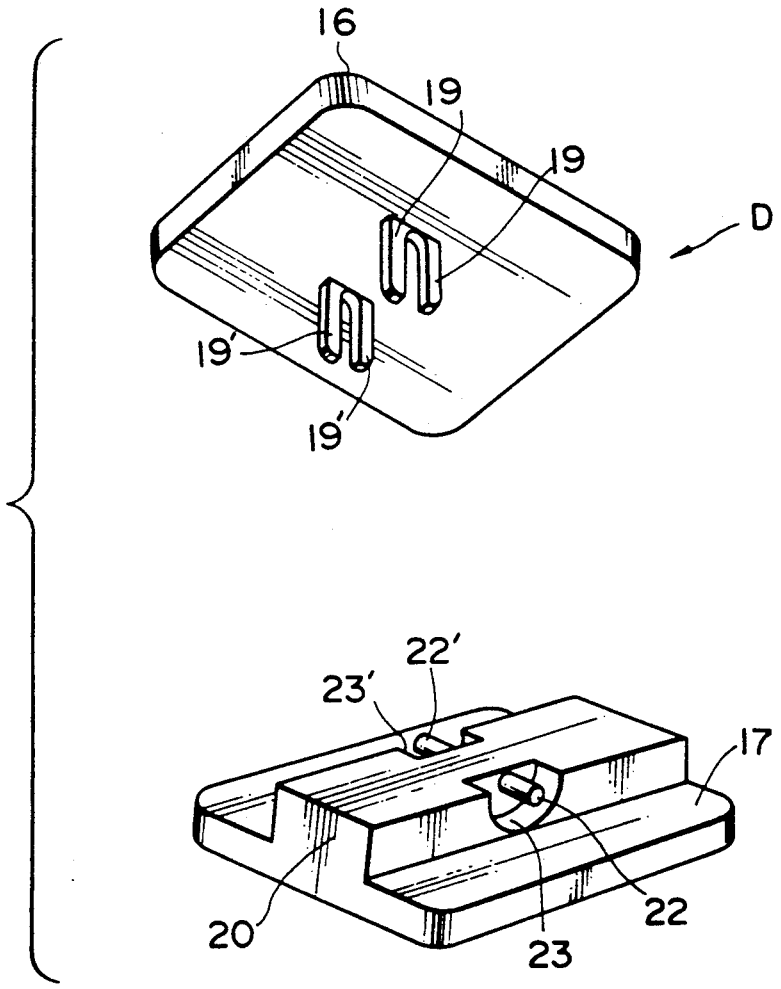
FIG. 4 is a view similar to FIG. 3 but shows a second embodiment of the present invention.

FIG. 4 shows a second embodiment of the present invention. This embodiment is substantially identical to the preceding embodiment except that, instead of the single pair of nails 19, 19, two opposed pairs of nails 19, 19; 19', 19' are provided on the inner surface of the first decorative part 16 of the decorative body D; and correspondingly a pair of concave recesses 23, 23' are formed in the opposite sides of the ridge 20 and a pair of pins 22, 22' each have its inner end fixed to the inner wall of the concave recess 23, 23' so as to be supported axially in the concave recess 23, 23'. With the two pairs of nails 19, 19; 19', 19' thus clinched to the two pins 22, 22', the first and second decorative parts 16, 17 are joined with each other more firmly and stably.

Figure 5:
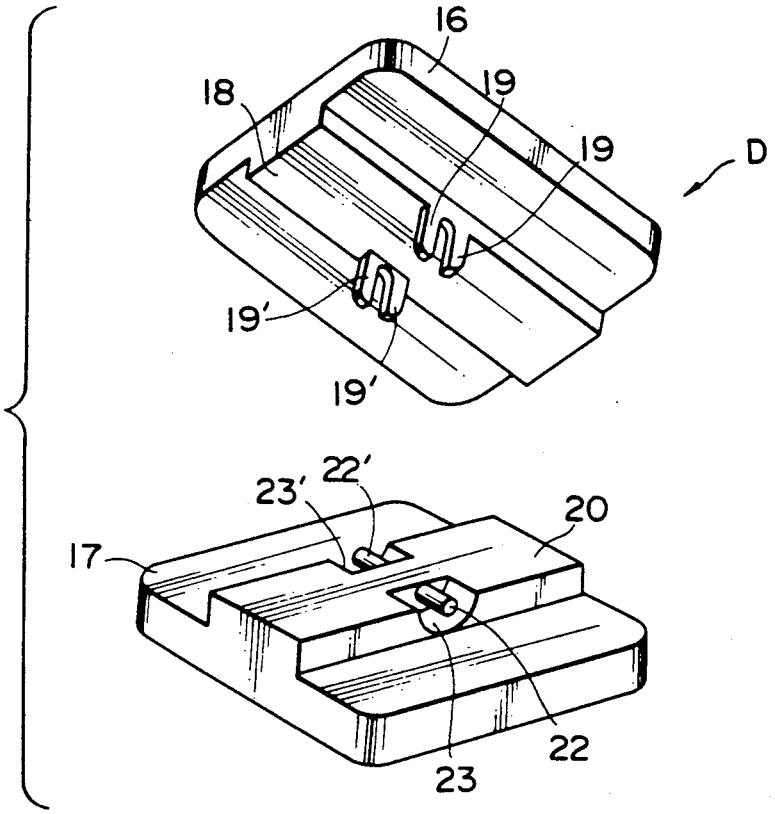
FIG. 5 is a view also similar to FIG. 3 but shows a third embodiment of the present invention.
Figure 6:
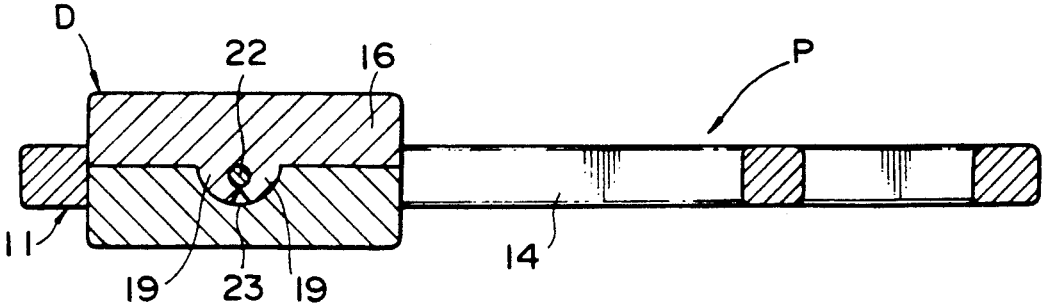
FIG. 6 is a view similar to FIG. 2 but shows a pull tab incorporating a decorative body of FIG. 5.

FIGS. 5 and 6 show a third embodiment according to the present invention. This embodiment is substantially identical with the second embodiment except that the ridge 20 is considerably less in height than that of the preceding embodiments and, to make up for the decreased height of the ridge 20, the first decorative part 16 has on its inner side, on the middle a rectangular parallelopiped platform 18 extending throughout the full length of the first decorative part 16. It is to be recognized that the combined heights of the opposed ridges 20 and platform 18 are slightly greater than the thickness of the pull tab body 11. As shown in FIG. 5, the two opposed pairs of nails 19, 19' are provided on the respective side edges of the platform 18.

Figure 7:
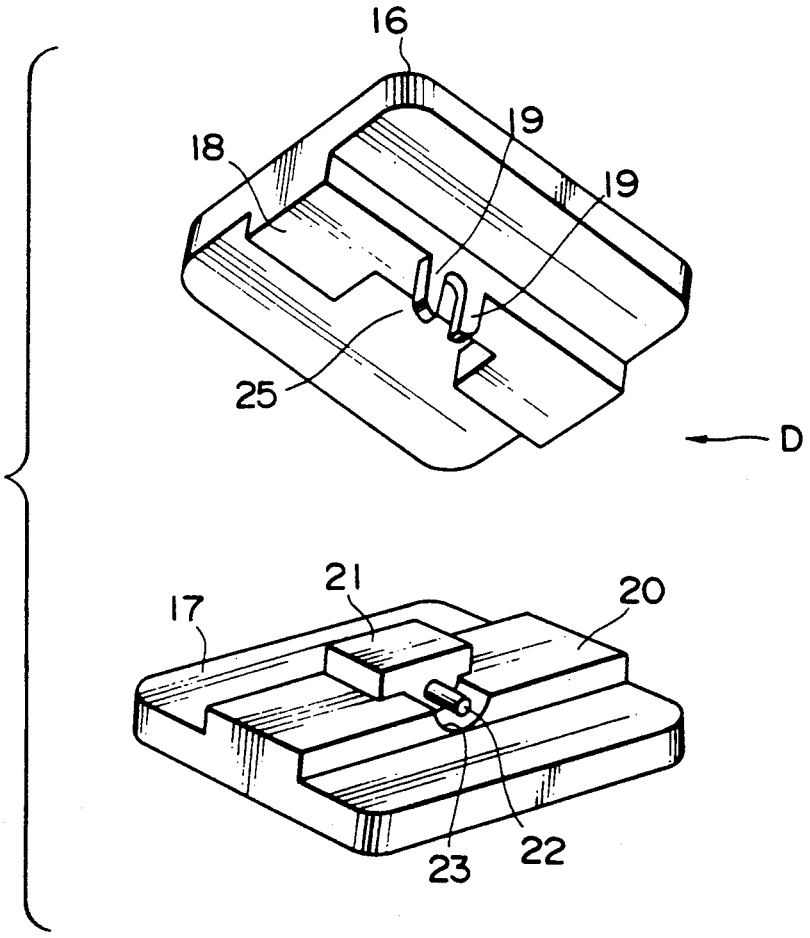
FIG. 7 is a view similar to FIG. 3 but shows a fourth embodiment of the present invention.

FIG. 7 shows a fourth embodiment of the present invention. The decorative body D according to this embodiment looks similar to that shown in FIG. 5. Unlike the decorative body D shown in FIG. 5, one of the two pairs of clamping nails 19, 19 are replaced with a rectangular cutout 25 formed in the side edge of the platform 18, while the corresponding concave recess 23 and pin 22 are replaced with a fitting lug 21 which is complementary in size and shape with the cutout 25. When the first decorative part 16 is joined with the second decorative part 17, the fitting lug 21 of the latter comes into fitting engagement with the cutout 25 of the former. The fitting engagement of the fitting lug 21 and the cutout 25 helps to prevent the first and second decorative parts 16, 17 from displacement relative to each other especially longitudinally thereof.

Figure 8:
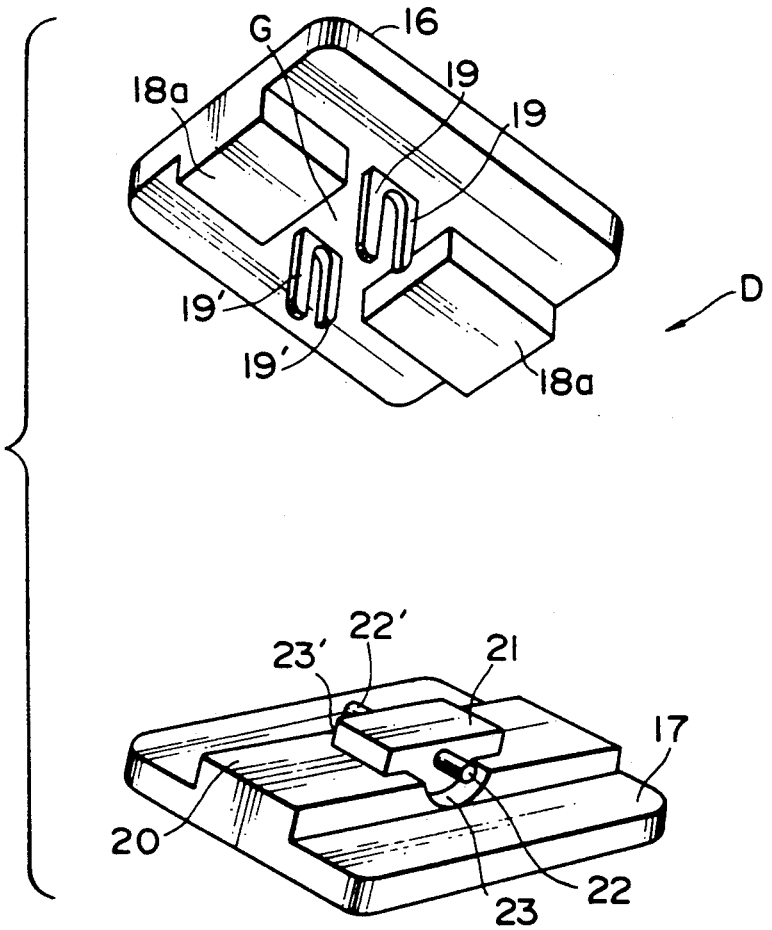
FIG. 8 is a view also similar to FIG. 3 but shows a fifth embodiment of the present invention.

FIG. 8 shows a fifth embodiment of the present invention which looks similar to the decorative body D shown in FIG. 7. The decorative body D of this embodiment is a so-called half-and-half between the decorative body D shown in FIG. 5 and that shown in FIG. 7. Instead of the single platform 18, a pair of platforms **18*a*, 18*a* are provided on the opposite ends of and on the inner surface of the first decorative part 16, with a gap G left therebetween. A pair of clamping nails 19, 19; 19', 19' are formed intermediate between the opposed platforms and disposed in opposed relation to each other. The ridge 20 has a fitting lug 21 on its upper surface in its middle. A pair of concave recesses 23, 23' are formed in the ridge 20 one in each side of the fitting lug 21. A pair of pins 22, 22' are mounted one on each side of the fitting lug 21 and are each disposed axially in the respective concave recess 23, 23'**.

Figure 2:
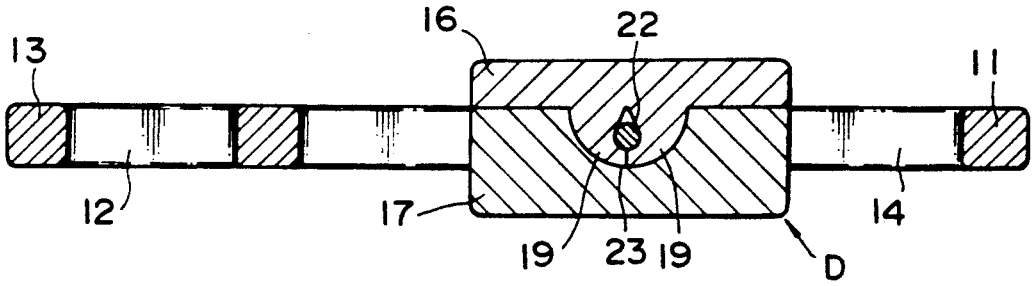
FIG. 2 is a cross-sectional view of the pull tab of FIG. 1.
Figure 9:
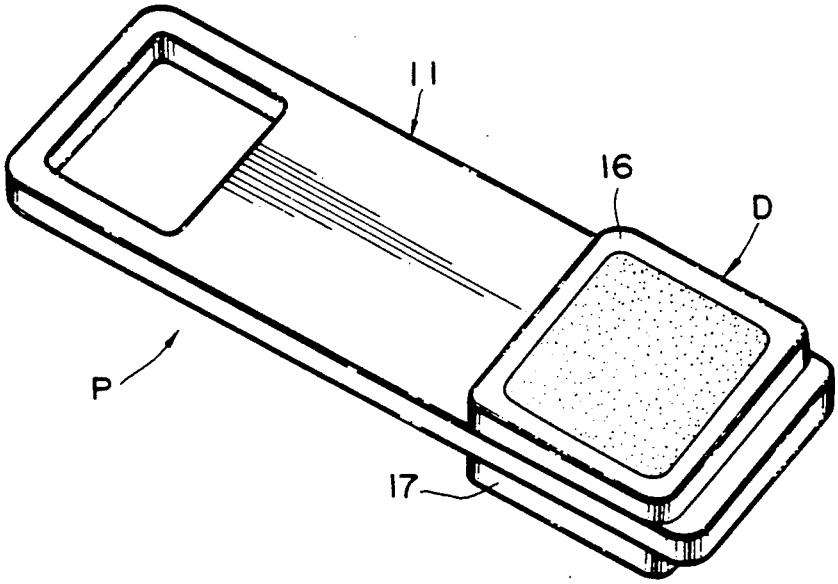
FIG. 9 is a perspective view of a pull tab similar to that shown in FIG. 1 but shows a sixth embodiment of the present invention.
Figure 10:
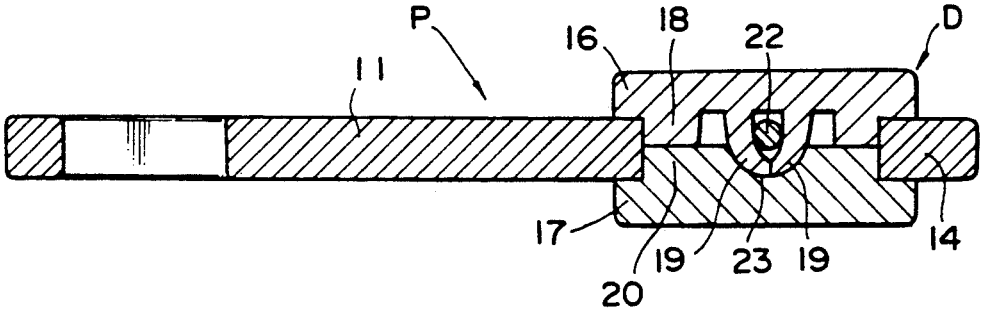
FIG. 10 is a cross-sectional view of the pull tab of FIG. 9.

In all the preceding embodiments, thanks to the presence of the elongate slot 14 in the pull tab body 11, the thus mounted decorative body D is slidable on the pull tab body 11, as better shown in FIGS. 1 and 2. On the other hand, FIG. 9 shows a sixth embodiment of the present invention wherein the attaching hole 14 is substantially equal in size and shape to the cross-section of the ridge 20 and the platform 18 for permitting the decorative body D to be stationary in place on the pull tab body 11.

Figure 11:
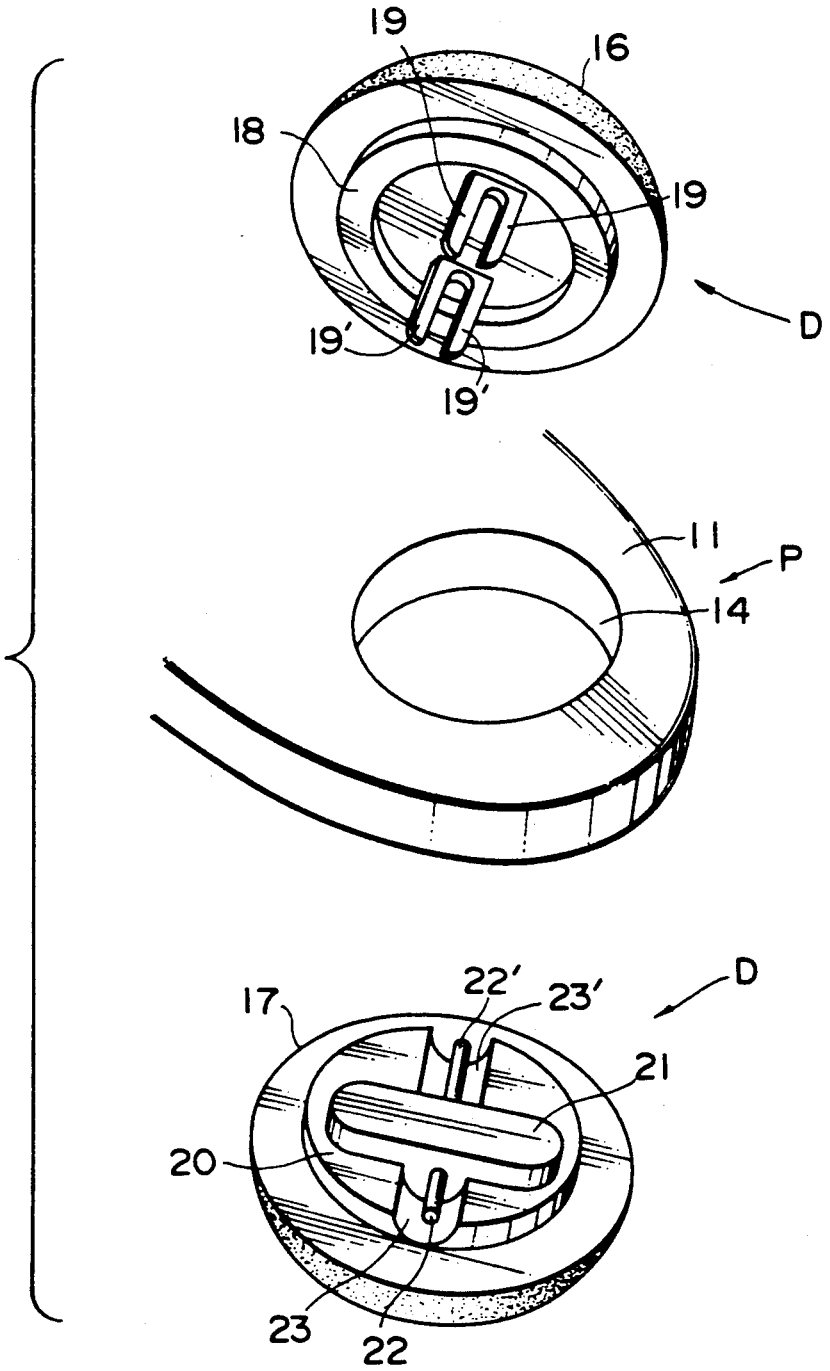
FIG. 11 is a fragmentary exploded perspective view of a pull tab according to a seventh embodiment of the present invention.
Figure 12:
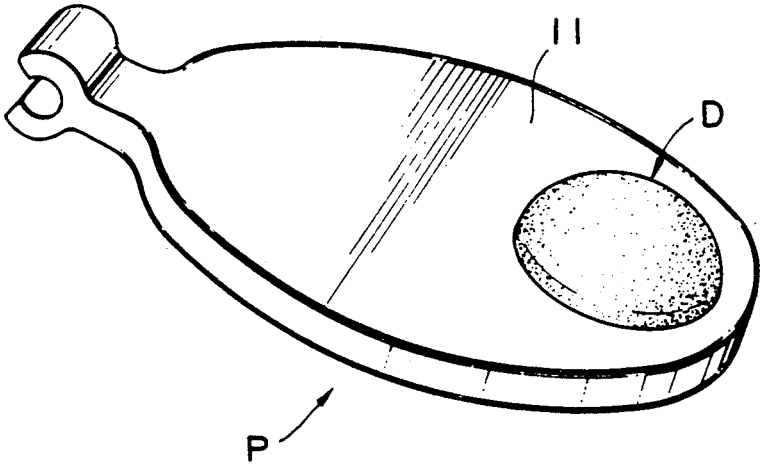
FIG. 12 is a perspective view of the pull tab of FIG. 11.

FIG. 11 shows a seventh embodiment of the present invention. In this embodiment, the pull tab body 11 has therein a circular attaching hole 14. Both first and second decorative parts 16, 17 are substantially hemispheric. The second decorative part 17 has a circular ridge 20 provided coaxially on its inner flat circular surface. A fitting lug 21 is provided diametrically on the circular ridge 20 and has its both ends terminate short of the periphery of the circular ridge 20. A pair each of concave recesses 23, 23' and pins 22, 22' are provided in this embodiment in substantially similar manner to those in the fifth embodiment shown in FIG. 8. The first decorative part 16 has an annual platform 18 provided coaxially on its inner circular flat surface thereof. A pair of clamping nails 19, 19; 19', 19' are provided on the flat surface and disposed in opposed relation within the annular platform 18. Since the first and second decorative parts 16, 17 are joined with each other with their respective annular platform and circular ridge 18, 20 received in the circular attaching hole 14 of the pull tab body 11, the decorative body D is rotatably mounted on the pull tab body 11.

With the construction of the present invention described above, the decorative body D of the pull tab P according to the present invention does not require any specific tool to clinch it to the pull tab body 11, so that many decorative body of various designs can be attached to the pull tab bodies 11 even by consumers themselves at their home so as to meet their individual tastes.

Furthermore, the deformed ends of the clamping nails 19, 19' are conveniently fully hidden out of sight, so that the pull tab P as a whole becomes very attractive in appearance.

Obviously, various modifications and variations of the present invention are possible in the light of the above teaching. It is therefore to be understood that within the scope of the appended claims the invention may be practiced otherwise than as specifically described.

What is claimed is:

1. A pull tab to be pivotally connected with a slider body of a slide fastener slider for manipulation of the slider, the pull tab comprising; a pull tab body being of a flat strip and having a through hole therein; and a decorative body comprising a first decorative part having a pair of opposed clamping nails on an inner surface and a second decorative part having an engaging ridge provided on an inner surface, the engaging ridge having a concave recess therein and a pin supported substantially axiallly in the concave recess; the first decorative part being joined with the second decorative part, with the ridge received in the through hole of the pull tab body, by forcing the clamping nails of the first decorative part into the concave recess astraddle of the pin, thereby clinching them to the pin, so that the decorative body is attached to the pull tab body.

2. A pull tab according to claim 1, the first decorative part further including another pair of clamping nails provided on its inner surface in opposed relation to the first-mentioned pair of clamping nails, the ridge including another concave recess formed therein in opposed relation to the first-mentioned concave recess and another pin supported axially in the second-mentioned concave recess, the second-mentioned clamping nails of the first decorative part being forced into the second-mentioned concave recess astraddle of the second-mentioned pin, to be thus clinched to the second-mentioned pin, so that the decorative body is attached more firmly and stably to the pull tab body.

3. A pull tab according to claim 1, the first decorative part having a platform provided on its inner surface, on which platform the clamping nails is provided, the platform coming into contact with the ridge, when the first decorative part is joined with the second decorative part.

4. A pull tab according to claim 3, the ridge having a fitting lug provided thereon, the platform having a cutout formed therein, the fitting lug coming into fitting engagement with the cutout when the platform comes into contact with the ridge.

5. A pull tab according to claim 1, the attaching hole comprising a rectangular elongated slot extending longitudinally of the pull tab body for permitting the decorative body to slide longitudinally of the pull tab body.

6. A pull tab according to claim 1, the ridge being non-circular in cross-section and the attaching hole being substantially equal in size and shape to the cross-section of the ridge for permitting the decorative body to be stationary in place on the pull tab body.

7. A pull tab according to claim 1, the ridge being circular in cross-section and the attaching hole being circular and slightly larger in diameter than the circular cross-section of the ridge for permitting the decorative body to rotate about the attaching hole on the pull tab body.

* * * * *